US005277234A

United States Patent [19]

Warstler

[11] Patent Number: 5,277,234

[45] Date of Patent: Jan. 11, 1994

[54] SELF VENTING FUNNEL

[76] Inventor: Christopher L. Warstler, 12945 Sarbaugh Ave. SW., Navarre, Ohio 44662

[21] Appl. No.: 31,701

[22] Filed: Mar. 15, 1993

[51] Int. Cl.[5] ..... B67C 11/00

[52] U.S. Cl. ..... 141/299; 141/331; 141/345; 141/297; 141/DIG. 1; 141/339

[58] Field of Search ..... 141/297-300, 310, 331, 336, 344, 345, 339, 391; DIG. 1

[56] References Cited

U.S. PATENT DOCUMENTS

| | | | |
|---|---|---|---|
| 8,928 | 5/1852 | Schneider | 141/298 |
| 334,564 | 1/1886 | Catlin | 141/299 |
| 357,476 | 2/1887 | Gersdorff | 141/310 X |

FOREIGN PATENT DOCUMENTS

| | | | |
|---|---|---|---|
| 331041 | 10/1935 | Italy | 141/299 |
| 1594133 | 9/1990 | U.S.S.R. | 141/391 |
| 20282 | of 1900 | United Kingdom | 141/299 |
| 6944 | of 1906 | United Kingdom | 141/299 |
| 196401 | 4/1923 | United Kingdom | 141/345 |

*Primary Examiner*—Ernest G. Cusick
*Attorney, Agent, or Firm*—Leon Gilden

[57] ABSTRACT

A funnel includes a truncated conical funnel head directed into a cylindrical guide conduit, with the guide conduit and funnel head oriented about a predetermined axis, and wherein a plurality of spaced parallel channels are directed into the funnel head and the guide conduit extending from a lowermost end of the funnel structure to an uppermost end thereof permitting venting when the funnel is directed within an opening of an associated container.

2 Claims, 4 Drawing Sheets

SELF VENTING FUNNEL

BACKGROUND OF THE INVENTION

1. Field of the Invention

The field of invention relates to funnel apparatus, and more particularly pertains to a new and improved self venting funnel wherein the same permits the venting of air through the funnel structure during a filling procedure.

2. Description of the Prior Art

Funnels of various types have been utilized throughout the prior art and wherein U.S. Pat. No. 3,938,563 indicates a venting funnel having a bleeder directed coaxially of the funnel structure.

U.S. Pat. Nos. 4,494,585 and 4,901,776 are further examples of venting funnels, wherein U.S. Pat. No. 4,976,297 to Peckels sets forth a further example of a funnel having a venting tube directed through the funnel adjacent an exterior wall thereof.

The instant invention attempts to overcome deficiencies of the prior art by providing for a self venting funnel including a plurality of channels symmetrically oriented about the funnel to permit the symmetrical venting within the associated container during a filling procedure and in this respect, the present invention substantially fulfills this need.

SUMMARY OF THE INVENTION

In view of the foregoing disadvantages inherent in the known types of funnel structure now present in the prior art, the present invention provides a self venting funnel wherein the same includes an annular array of channels directed along an exterior surface of the funnel for venting within an associated container. As such, the general purpose of the present invention, which will be described subsequently in greater detail, is to provide a new and improved self venting funnel which has all the advantages of the prior art funnel apparatus and none of the disadvantages.

To attain this, the present invention provides a funnel including a truncated conical funnel head directed into a cylindrical guide conduit, with the guide conduit and funnel head oriented about a predetermined axis, and wherein a plurality of spaced parallel channels are directed into the funnel head and the guide conduit extending from a lowermost end of the funnel structure to an uppermost end thereof permitting venting when the funnel is directed within an opening of an associated container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved self venting funnel which has all the advantages of the prior art funnel apparatus and none of the disadvantages.

It is another object of the present invention to provide a new and improved self venting funnel which may be easily and efficiently manufactured and marketed.

It is a further object of the present invention to provide a new and improved self venting funnel which is of a durable and reliable construction.

An even further object of the present invention is to provide a new and improved self venting funnel which is susceptible of a low cost of manufacture with regard to both materials and labor, and which accordingly is then susceptible of low prices of sale to the consuming public, thereby making such self venting funnels economically available to the buying public.

Still yet another object of the present invention is to provide a new and improved self venting funnel which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
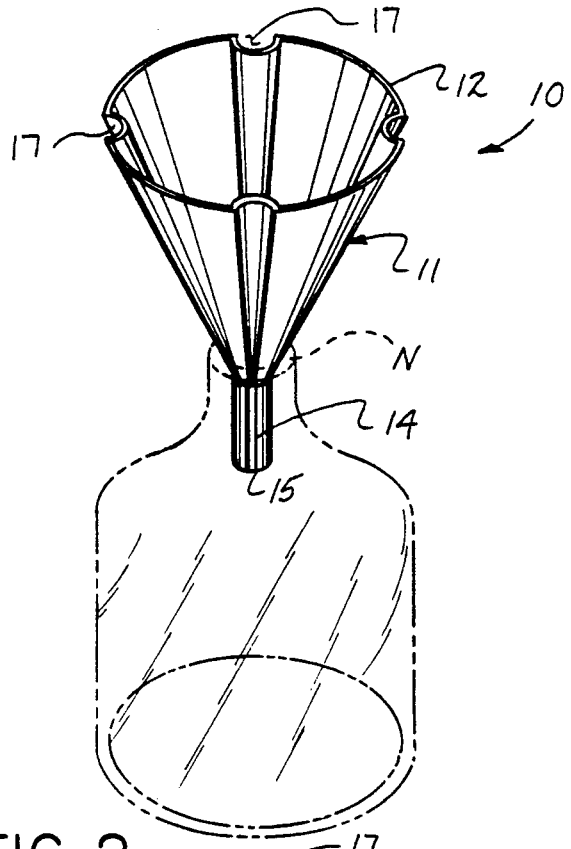
FIG. 1 is an isometric illustration of the invention.
Figure 2:
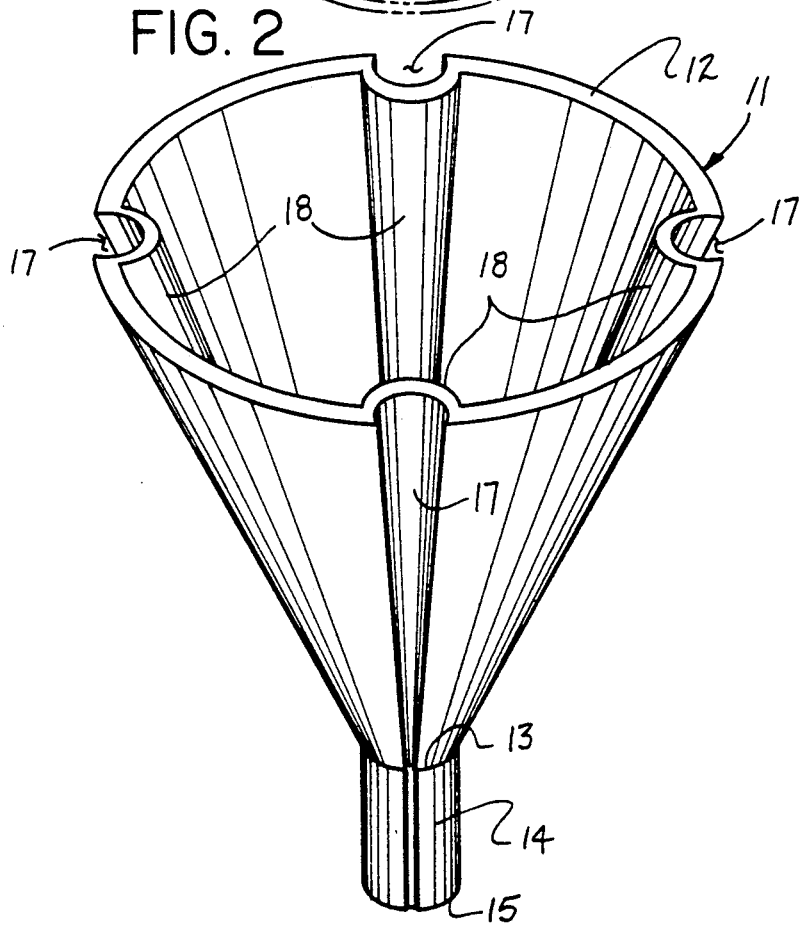
FIG. 2 is an enlarged isometric illustration of the funnel structure of the invention.
Figure 3:
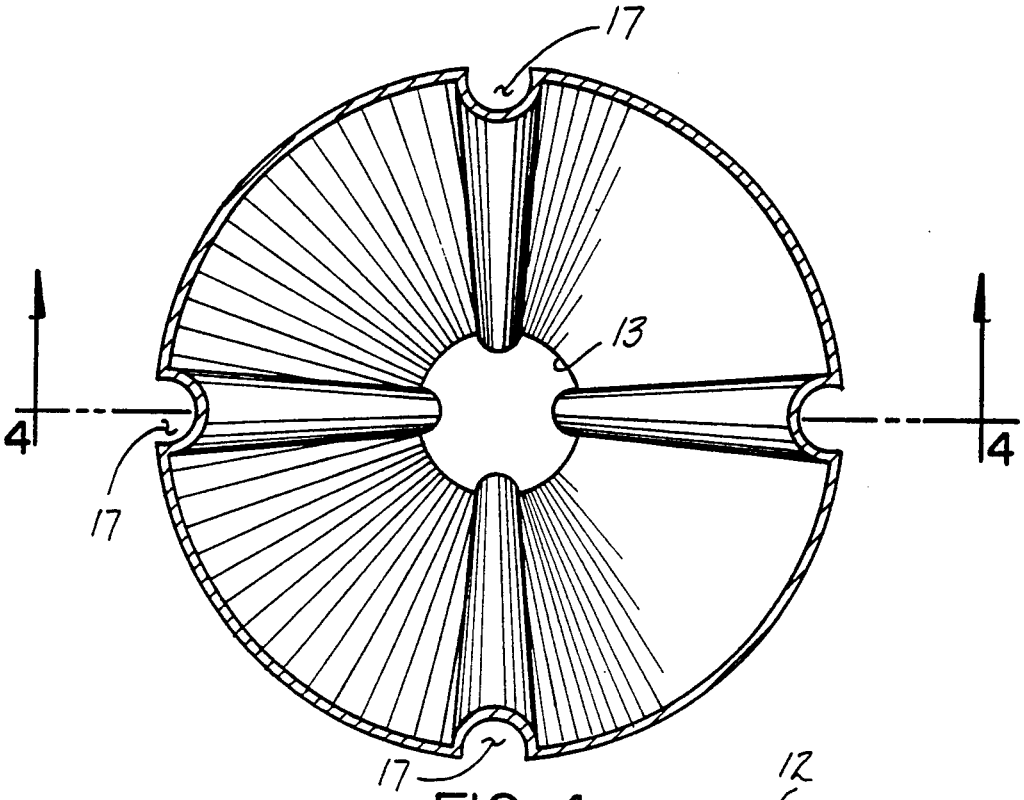
FIG. 3 is an orthographic top view of the funnel structure.
Figure 4:
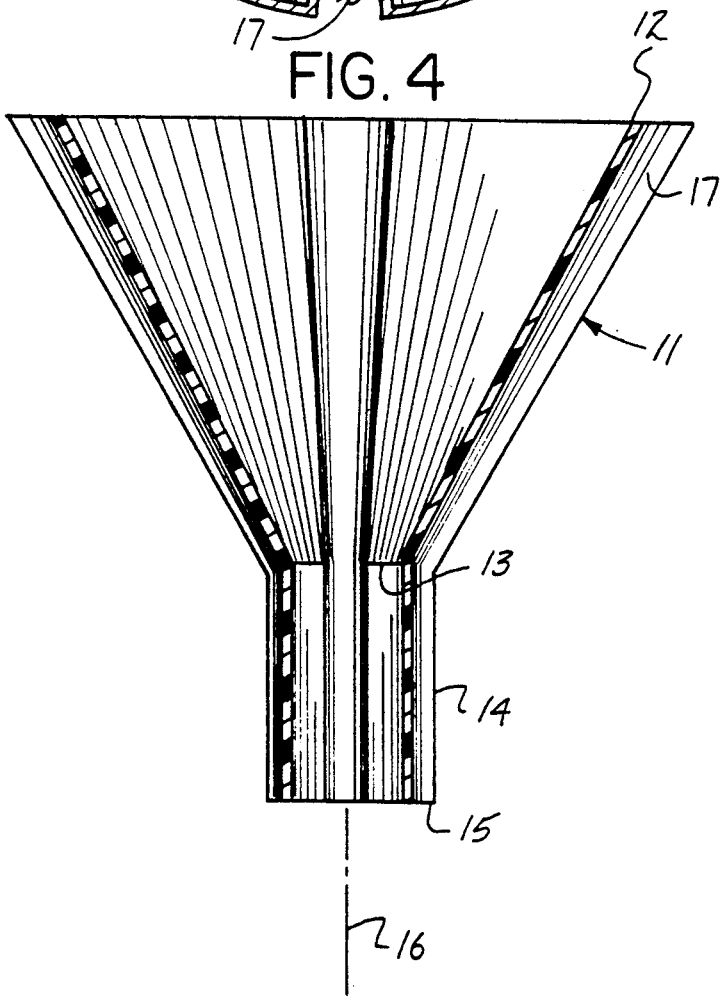
FIG. 4 is an orthographic view, taken along the lines 4—4 of FIG. 3 in the direction indicated by the arrows.

With reference now to the drawings, and in particular to FIGS. 1 to 8 thereof, a new and improved self venting funnel embodying the principles and concepts of the present invention and generally designated by the reference numeral 10 will be described.

More specifically, the self venting funnel 10 of the instant invention essentially comprises a truncated conical frontal head 11 configured in an inverted relationship relative to a cylindrical guide conduit 14, as the funnel head 11 and the guide conduit 14 are symmetrically oriented about a predetermined axis. The funnel head 11 includes an annular entrance periphery 12 of a first diameter, and an annular exit funnel head end 13 of a second diameter less than the first diameter, with a cylindrical guide conduit 14 configured of a second diameter extending from the exit funnel head end 13. The guide conduit 14 includes a guide conduit exit end 15.

A plurality of spaced vent channels 17 are directed into the exterior surface of the funnel head 11 and the guide conduit 14 extending orthogonally between the entrance periphery 12 coextensively along the exterior surface of the funnel 10 directed to the guide conduit exit end 15. Each of the channels 17 include a projecting channel rib 18 extending within the interior of the funnel head 11, as well as the guide conduit 14. In this manner, the channel structure coextensive with the funnel arrangement provides for venting along the exterior surface of the funnel 10 when the funnel is directed within a container neck opening end, as indicated in FIG. 1.

Figure 5:
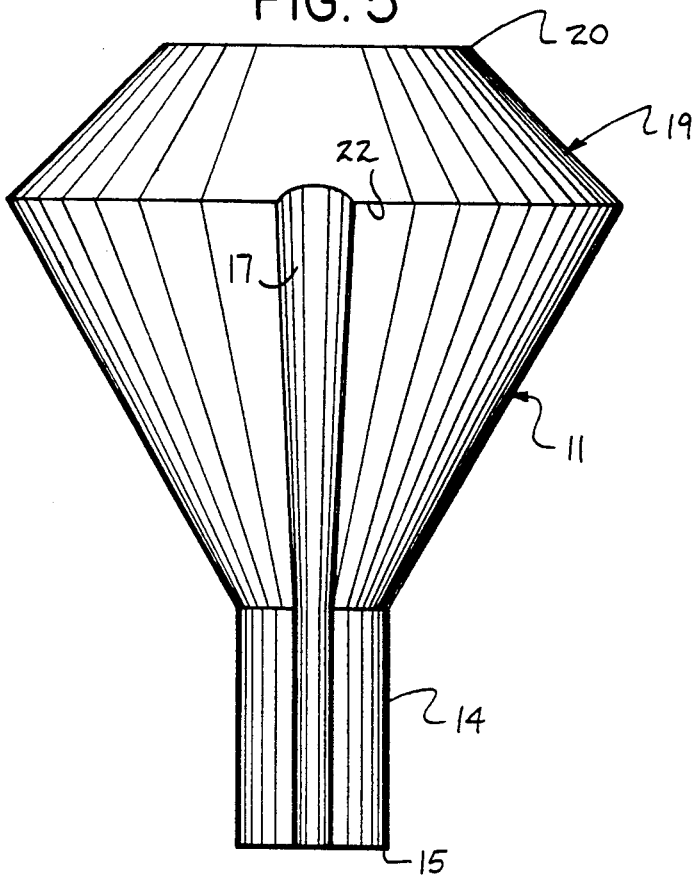
FIG. 5 is an orthographic view of the funnel structure employing a shield member.
Figure 6:
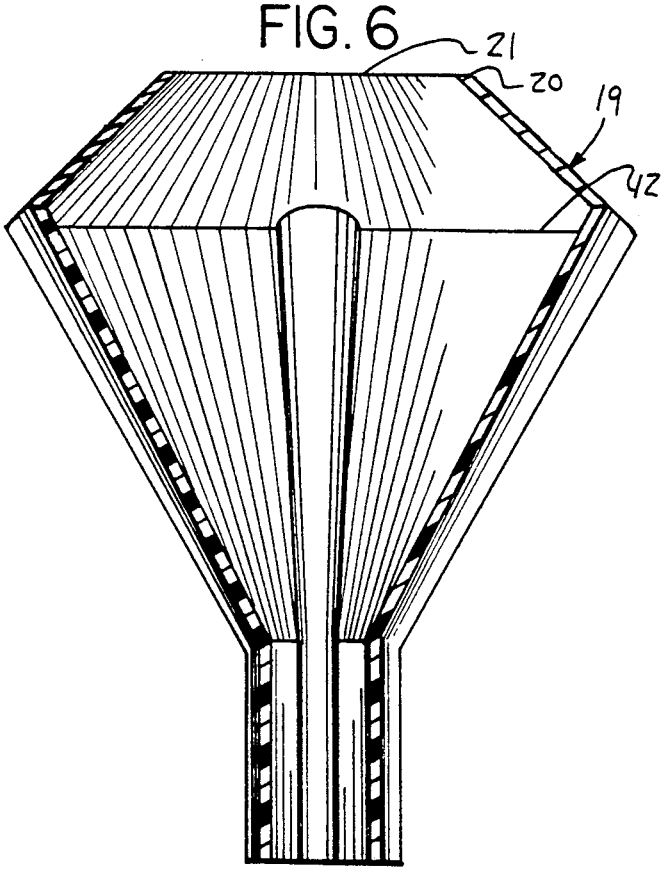
FIG. 6 is an orthographic cross-sectional illustration of the funnel and the shield member.

The FIGS. 5 and 6 indicates the further employment of a truncated conical shield member 19*a* formed of a ferromagnetic material at the shield second end 22 that equals the first diameter in an annular configuration for engagement with the ferrous metallic surface of the annular entrance periphery 12. The shield 19 includes a shield first end 20 having a third diameter less than the first diameter and greater than the second diameter to direct fluid therewithin and provide for a splash shield and directing of fluid within the funnel structure.

Figure 7:
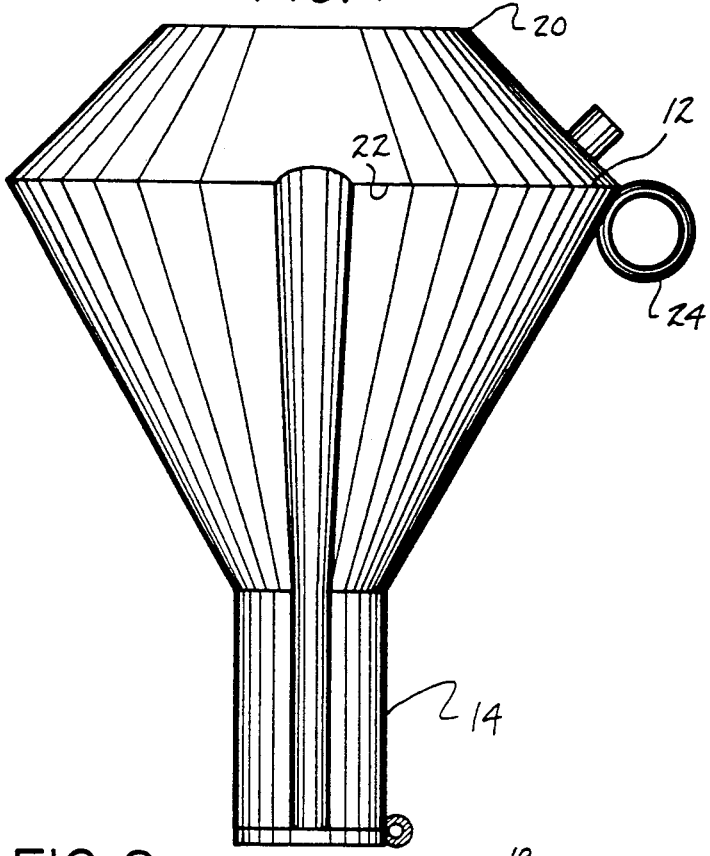
FIG. 7 is an orthographic view of the shield member having a closure lid at a lowermost end of the funnel structure.
Figure 8:
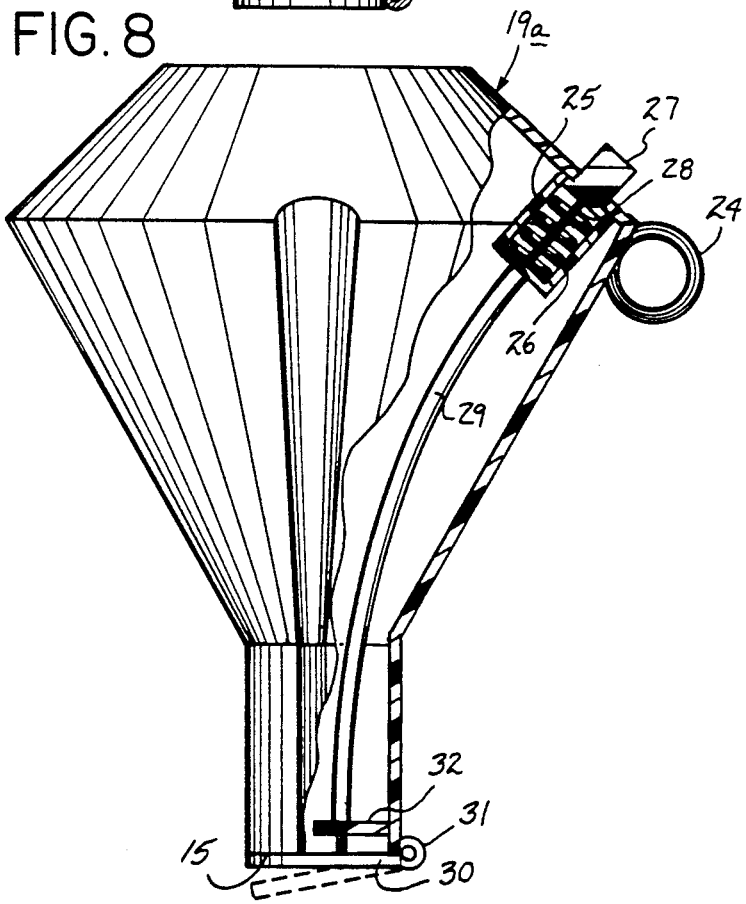
FIG. 8 is an orthographic view, partially in section, indicating the operation and construction of the closure lid, as indicated in FIG. 7.

The modified shield 19*a*, as indicated in FIGS. 7 and 8, indicates the use of a spring housing 25 fixedly mounted within the shield in adjacency to the second end 22, wherein the spring housing 25 includes a spring 26 therewithin arranged to deflect a button member 27 exteriorly of the shield, as indicated in FIG. 8. A cable 28 is mounted to the button member that in turn is directed through a sheath 29 that is fixedly mounted to the housing 25 and to a guide lug 32 at the guide conduit exit end 15. The cable 28 is directed through the shield and mounted to a door plate 30, that in turn is hingedly mounted about a hinge 31 to the guide conduit exit end 15. A handle ring 24 is mounted to the funnel head 11 adjacent the funnel head entrance periphery 12 to permit the selective opening of the door directing fluids therewithin, whereupon containment of fluids within the funnel structure is afforded thereby preventing over-filling of a container, in a manner as utilized in FIG. 1.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A self venting funnel, comprising, a truncated conical funnel head, having an annular entrance periphery of a first diameter, and an exit funnel head end of a second diameter less than the first diameter, with a cylindrical guide conduit fixedly mounted to the exit funnel head end, having a guide conduit diameter equal to the second diameter, and the guide conduit includes a guide conduit exit end spaced from the funnel head end, and the funnel head and the guide conduit are symmetrically oriented about a predetermined axis, and a plurality of spaced vent channels are directed into an exterior surface of the funnel head and the guide conduit extending in a parallel relationship relative to one another and to the predetermined axis, and extending from the annular entrance periphery to the guide conduit exit end, and each of the vent channels project within the funnel head and the guide conduit to provide for guide ribs directing lamina flow through the funnel head and the guide conduit of fluid directed into the funnel head, and a truncated conical shield having a shield first end of a third diameter less than the first diameter and greater than the second diameter, defining a shield entrance opening therewithin, with the shield having a shield second end, the shield second end having a second end diameter equal to the first diameter, and wherein the shield second end is formed of a ferrous metallic material, and wherein the annular entrance periphery of the funnel head is formed of ferromagnetic material for selective adherence of the shield to the funnel head.

2. A funnel as set forth in claim 1 including a handle fixedly mounted to the funnel head in adjacency to the annular entrance periphery, and a spring housing fixedly mounted to the shield adjacent the shield second end, with the spring housing having a spring therewithin, and a button member mounted within the spring housing in communication with the spring for biasing the button member exteriorly of the shield, and a guide lug fixedly mounted within the guide conduit adjacent the guide conduit exit end, and a cable fixedly mounted between the spring housing and the guide lug, and a cable slidably directed through the cable sheath, with the cable having a cable first end mounted to the button member, and a cable second end directed to the guide conduit exit end, and a door plate, including a door plate hinge hingedly mounting the door plate relative to the guide conduit exit end, and the cable second end fixedly mounted to the door plate to permit displacement of the door plate upon projection of the button member within the spring housing.

* * * * *